United States Patent [19]

Marinoni

[11] Patent Number: 4,655,025

[45] Date of Patent: Apr. 7, 1987

[54] EDGE RAIL FOR A WINDOW PANE, IN PARTICULAR AN ALL-GLASS DOOR

[75] Inventor: Mario Marinoni, Magenta, Italy

[73] Assignee: Casma Di V. Marinoni & Figli, Magenta, Italy

[21] Appl. No.: 701,130

[22] Filed: Feb. 13, 1985

[30] Foreign Application Priority Data

Feb. 13, 1984 [DE] Fed. Rep. of Germany ... 8404254[U]

[51] Int. Cl.[4] ..... E04B 1/60

[52] U.S. Cl. ..... 52/771; 52/777; 52/825

[58] Field of Search ..... 52/771, 770, 777, 824, 52/825

[56] References Cited

U.S. PATENT DOCUMENTS 1,985,174 12/1934 Kneeshaw ..... 52/771

FOREIGN PATENT DOCUMENTS 1003424 2/1957 Fed. Rep. of Germany ..... 52/771

7539446 12/1975 Fed. Rep. of Germany ..... 52/771

2805258 8/1979 Fed. Rep. of Germany ..... 52/771

*Primary Examiner*—Carl D. Friedman

*Assistant Examiner*—Naoko N. Slack

*Attorney, Agent, or Firm*—Toren, McGeady and Goldberg

[57] ABSTRACT

The edge rail for a window pane (3) in particular an all-glass door comprises at least two clamping rail sections (5, 7) which embrace the edge of the pane (3) and are spaced apart in the longitudinal direction of the edge, each comprising two profiled rail members interconnected by clamping screws (41) extending transversely to the face of the pane. A fitting, e.g. a flanged rail mortice lock (9) is provided between the two clamping rail sections (5, 7) fixed to both clamping rail sections (5, 7) preferably via spacer members (17, 19). It is not necessary to mill rebates into the preferably extruded profiles of the clamping rail sections for accommodating the lock. Cover strips are fitted in positive engagement, releasably to the clamping rail sections (5, 7).

10 Claims, 2 Drawing Figures

EDGE RAIL FOR A WINDOW PANE, IN PARTICULAR AN ALL-GLASS DOOR

FIELD OF THE INVENTION

The invention relates to an edge rail for a pane, e.g. of glass, in the form of a window pane or an all-glass door comprising at least two clamping rail sections embracing the edge of the pane and spaced apart in the longitudinal direction of the edge each section comprising two profiled rail members interconnected by clamping screws extending transversely to the face of the window pane or by equivalent means, including at least one fitting member releasably fitted to at least one of the profiled rail members and comprising two cover strips covering the clamping rail sections and the gap therebetween on both sides of the pane, releasably fitted to the clamping rail sections.

DISCUSSION OF PRIOR ART

An edge rail of the above type is known from German Utility Model 75 39 446. The clamping rail sections each have identical cross sections and have been cut to length from extruded profiled rails. Support ribs and reinforcing ribs project towards one another from the mutually facing surfaces of the extruded profiled rails. If it is intended that the edge rail is to accommodate relatively large fittings, e.g. floor bolt bar locks or the like, it is necessary with edge rails of the conventional type to machine rebates into the ribs which substantially increases the manufacturing costs. Moreover with the known edge rail the clamping rail sections must be fitted individually to the pane and be aligned with one another.

From DE-OS 28 05 258 an edge rail for an all-glass door is known in which the clamping rail sections prior to their being fitted to the pane are brought into alignment with one another by being fitted to assembly jigs for the cover strips. In this manner the clamping rail sections are necessarily fitted to the pane in mutual alignment in a simple manner. However, once again the lock in the case of such edge rail is fitted into a specially machined rebate in one of the clamping rail sections.

THE INVENTION

According to one aspect it is an object of the invention to so improve an edge rail of the type referred to in the introduction that its clamping rail sections are necessarily mutually aligned when being fitted to the glass pane without the aid of mounting jigs or the like whilst in addition the fitting of relatively large fittings, in particular of locks to the clamping rail sections is facilitated.

A further or alternative object is to provide cover strips which can readily be interchanged to provide different outward appearances.

Other objects and advantages will become apparent from what follows.

In accordance with one aspect of the invention there is provided an edge rail as set out in the opening paragraphs, wherein the fitting member, in particular a lock, is provided in the longitudinal direction of the edge of the pane between the two clamping rail sections and is affixed to profiled rail members of both clamping rail sections.

The fitting member is fitted essentially outside the clamping rail section. When using extruded profiled rails it is not necessary to machine rebates for the fitting member. It is merely necessary to cut the required lengths of the extruded profiled rails and if necessary to provide these with mounting apertures. On the other hand the space available for the fitting member between the edge of the pane and the edge of the edge rail remote from the pane is unencumbered by ribs or webs or the like of the clamping rail sections, such that locks having larger bolt bar strokes than in the past can be used.

The length of the structural unit formed by preferably merely two clamping rail sections, albeit of different lengths, and the fitting member, in particular the lock is preferably selected to equal approximately the width of the pane in order to on the one hand distribute the clamping forces over large areas and on the other hand to facilitate the alignment of the edge rail during assembly.

The lock preferably takes the form of a flanged mortice lock and is fitted by means of its flange rail to the clamping rail section. Such locks are available in numerous practical forms even with comparatively large operating strokes of the bolt bar, and accordingly it is not necessary to employ special constructions. The flange rail interconnects the clamping rail sections and forces these into mutual alignment.

The flange rail which extends longitudinally in relation to the edge of the pane preferably finds support against a profile side face of one of the profiled rail members of each of the two clamping rail sections, the profiled side face extending in the longitudinal direction of the edge and at right angles to the face of the pane. Conventionally this profile side face extends along the inside of the edge rail at a distance from that longitudinal edge thereof which is remote from the pane in order to provide accommodation for further fittings to be accommodated at this profile side face, in particular one limb of a hinge or the like. In order to bring the flange rail as close as possible to the edge of the edge rail which is remote from the pane and to utilise the stroke of the bolt bar as well as possible the flange rail is preferably fitted by way of spacer members.

In the case of edge rails of the type referred to in the introduction the cover rails along their longitudinal edges comprise portions at an angle thereto which engage behind the longitudinal edges of the profiled rail members. The profiled rail members have rectangular outer contours adapted to the configuration of the cover strips. If it is intended to modify the exterior shape of the cover strips, the shape of the profile rail members must similarly be changed. A further aspect of the invention which can be utilised also in the context of edge rails for window panes other than those explained further above, in particular for all-glass doors, permits varying the configuration of the cover strips without at the same time having to modify the configuration of the profiled rail members.

Accordingly a further aspect of the invention provides an edge rail for a pane in the form of a window pane or all-glass door, comprising clamping rail means embracing the edge of the pane and spaced apart in the longitudinal direction of the edge each section comprising two profiled rail members interconnected by clamping screws extending transversely to the face of the pane or by equivalent means and comprising two cover strips covering the clamping rail means, wherein the cover strips and the profiled rail members on sides facing each other comprise locking profiles extending in the longitudinal direction of the rim and which, optionally by way of locking members extending in the longitudinal direction of the rim, by virtue of positive interengaging support, hold the cover strips to the profiled rail members, wherein the locking profiles of the cover strips take the form of ribs projecting towards the profiled rail member and extending at a distance from each of the two longitudinal edges of the cover strip. The cross sectional configuration in the region of the two longitudinal edges of the cover strip can be varied in this manner without the configuration of the profiled rail members and in particular their interlocking profiles having to be changed. For that purpose the longitudinal edges of the profiled rail members adjoining the pane may be chamfered towards one another and towards the pane on that side which is remote to the pane.

The appearance of the cover strips can be varied in a particularly large variety of ways if the cover strip takes the form of an extruded profiled strip and carries a covering adapted to the configuration of its outer surface made of a different material or a material with different surface properties.

In the following the invention will be explained further by way of working examples with reference to the drawing.

BRIEF DESCRIPTION OF THE DRAWINGS

There is shown in.

DESCRIPTION OF PREFERRED EMBODIMENTS

Figure 1:
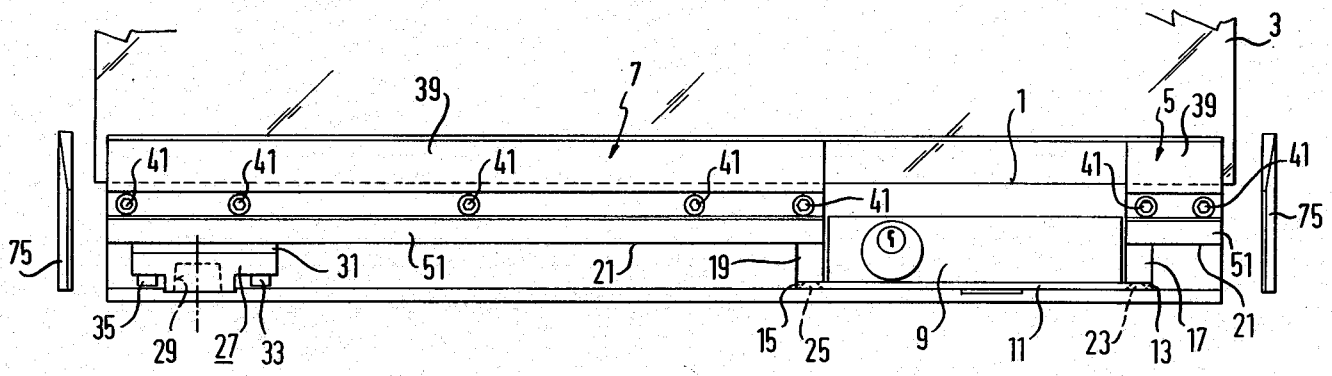
FIG. 1 a front elevation of the lower edge rail of an all-glass door from which the front cover strip has been removed.

The edge rail comprises two clamping rail sections 5, 7 spaced apart in the longitudinal direction of the edge and interconnected to form a structural unit by a flanged lock 9. The flange lock 9 which may be a conventional mortice lock carries a flange rail 11 extending in the longitudinal direction of the rim and normal to the face of the window pane and having ends 13, 15 which in the longitudinal direction of the edge of the pane project beyond the body of the flanged lock 9 and is screwed by way of spacer members 17, 19 to a mounting surface 21 of each of the two clamping rail sections 5, 7, extending similarly normal to the face of the pane, by means of screws 23, 25 entering from the free longitudinal side of the edge rail.

The clamping rail sections 5, 7 interconnected by way of the flanged lock 9 may be applied to the edge 1 of the glass pane 3 as a preassembled structural unit and be fitted relatively quickly. For accommodating the flange lock 9 it is not necessary to machine any rebates into the clamping rail sections 5, 7, e.g. by milling, other than the mounting apertures for the screws 23, 25; neither is it necessary to machine rebates into the edge 1 of the glass pane 3. The space between the edge 1 of the glass pane 3 and the longitudinal edge of the rail remote from the pane is available entirely to provide the height needed for the flanged lock 9, for which reason even locks of which the bolt lock stroke is comparatively large can be installed.

The clamping rail sections 5, 7 differ in length. The longer clamping rail section 7 in the region of its end remote from the lock carries a hinge fitting 27 including a bearing aperture 29 open toward the free longitudinal edge of the edge rail for a bearing pin in fixed relationship to the door frame and which is not illustrated. The hinge fitting 27 is screwed, supported against the mounting surface 21 of the clamping rail section 7 by means of screws 33, 35 via a spacer plate 31. The length of the clamping rail section 5, 7 having regard to the desired position of installation of the flanged lock 9, is so dimensioned that the overall length of the structural unit composed of the clmaping rail sections 5, 7 and the flanged lock 9 corresponds essentially to the length of the edge 1, i.e. the width of the all-glass door. In this manner the clamping pressure of the clamping rail sections 5, 7 is distributed over a relatively large marginal surface region and the alignment of the edge rail during fitting is facilitated.

Figure 2:
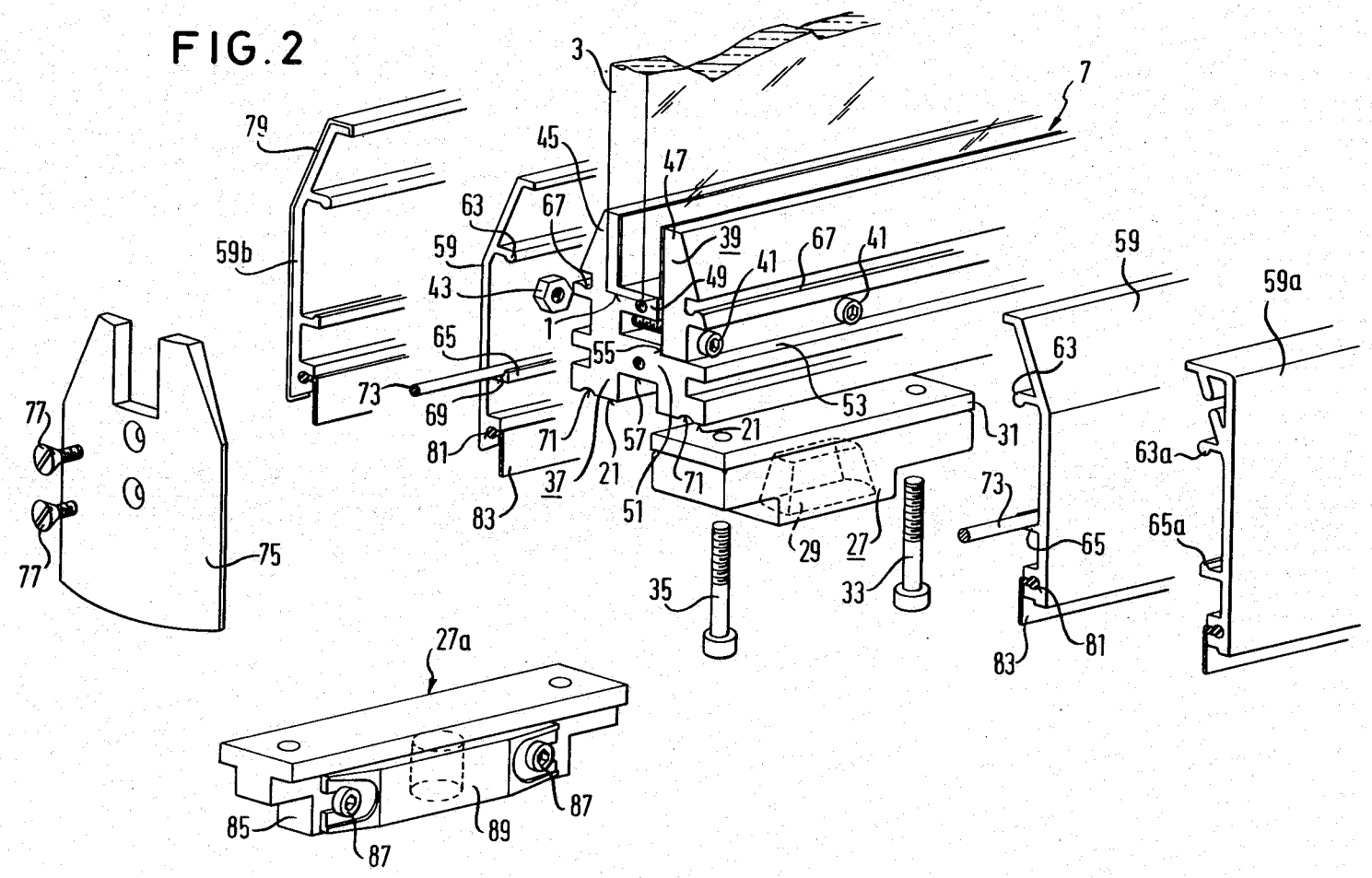
FIG. 2 an exploded view of the end of the edge rail on the hinge side of the door with additional illustrated modifications.

The clamping rail sections 5, 7 have the same cross sectional profile and, as can be seen most clearly from FIG. 2 each comprises two profiled rail members 37, 39 cut to length from extruded profiled rails. The profiled rail members 37, 39 are supported in mutual alignment and fixed to one another by way of screws 41 extending transversely to the face of the pane and nuts 43 or threaded holes cut into one of the profiled rail members. The clamping rail members 37, 39 comprise clamping jaws 45, 47 between which the glass pane 3 is clamped. The clamping jaw 45 of the clamping rail section 37 is followed by a supporting rib 49 extending in the longitudinal direction and projecting towards the opposite jaw 47 and is brought during fitting of the edge rail into abutment against the edge 1 of the glass pane 3 thereby facilitating alignment. Once the edge rail has been fitted the glass pane 3 finds support against the support rib 49. At a distance from the support rib 49 the profiled rail member 37 carries a longitudinally extending mounting flange 51 projecting transversely to the glass pane 3 beyond the support rib 49 and forming a support shoulder 55 directed towards the profiled rail member 39 on its side surface 53 directed towards the glass pane 3. The side surface 53 and the supporting shoulder 55 guide the profiled rail member 39 pivotally moveably around an axis extending in the longitudinal direction in relation to the profiled rail member 37. The screws 41 are fitted between the support shoulder 55 and the edge 1 of the glass pane 3 and provide a pincer-like clamping movement of the two clamping jaws 45, 47.

The surface of the mounting flange 51 facing away from the edge 1 of the glass pane 3 constitutes the mounting surface 21 which in the illustrated working example is interrupted by a longitudinal groove 57. The screws 33, 35 by means of which the hinge fitting 27 is screwed to the clamping rail section 7 are screwed into threaded holes, not shown in detail, in the region of the bottom of the groove 57 of the mounting flange 51. The flange lock 9 is fixed in the same manner by means of screws 23, 25 to the mounting flange 51.

The outer surfaces of the clamping rail sections 5, 7 facing away from the glass pane 3 are covered over the entire length of the edge rail by cover strips 59. The cover strips 59 have identical cross sectional profiles and are cut to length from extruded profiled strips. They each carry on their surfaces facing towards the clamping rail sections 5, 7 two profile ribs 63, 65 extending spaced apart from one another and from each of the two longitudinal edges of the cover strips 59 in the longitudinal direction. The profile ribs 63 are held in engagement with rebated grooves 67 on that side of the clamping jaws 45, 47 which is remote from the pane.

The opening width of the groove 67 is so dimensioned that the ribs 63 can be inserted transversely to the longitudinal direction of the groove and be locked in positive engagement by transverse displacement on the mounting flange 51. The ribs 65 engage behind that side of mounting flange 51 remote from the pane and carry longitudinal grooves 69 open towards the mounting flange 51 and which on the side of the mounting flange 51 remote from the pane are opposed to longitudinal grooves 71. The cover strips 59 after having been fitted to the profiled rail members 37, 39 are locked positively in place by the locking rods 73. The locking rods 73 are inserted in longitudinal direction into the passage formed by the grooves 69, 71. The end faces of the edge rail are covered in the conventional manner by cover plates 75 which by means of screws 77 are screwed to the end faces of the supporting ribs 49 or of the mounting flange respectively, thereby fixing the cover strips 59 longitudinally. Instead of the locking rods 73 it is also possible to employ axially slotted and thus radially spring loaded tubes inserted and affixed into one of the grooves 69 or 71 which during the fitting of the cover strips enter the respective other groove with a snap action.

The outside of the clamping jaws 45, 47 facing away from the pane 3 are chamfered towards one another and towards the pane 3. The profile of the cover rails 59 in that region follows the outer contours of the clamping jaws 45, 47. Both cover strips 59 thereby attain a trapezium-shaped exterior contour. Without changing the profiled rail members 37, 39 the outer contours of the cover rails can be varied as illustrated in FIG. 2 on the right hand side for a different embodiment of a cover strip **59*a*, essentially by merely modifying the marginal region of the cover strip 59*a* whilst the profile shape of the cover strip in the region of the ribs 63, 65 matching the ribs 63*a* and 65*a* and between these ribs remains unchanged. The cover strip 59*a*** essentially has rectangular external contours. However, other external contours are also possible, for example rounded longitudinal edges.

In the left hand portion of FIG. 2 a cover strip **59*b* is illustrated which differs from the cover strip 59 by an additional cover 79 covering the external surface. The cover 79 passes around the longitudinal edges of the cover strip 59*b* and may be crimped on or adhesively bonded on or fixed in another manner. The cover 79 may be made of metal or plastics and may have any surface characteristics corresponding to the desired appearance. Of course it is also possible for the cover strip 59*a*** to be provided with such a cover.

The cover strips 59 on that side which is remote from the pane project beyond the ribs 65 and cover the fittings provided on the mounting flange 51, in particular the hinge fitting 27 or the flanged lock 9. Along the edge of the cover strip 59 remote from the pane a longitudinal groove 81 is formed on that side facing towards the pane and inside which the enlarged edge of a rubber beading 83 or the like projecting beyond the longitudinal edge of the cover strip 59 remote from the pane is held in positive engagement.

In FIG. 2, left lower portion, a different embodiment of a hinge fitting **27*a* is illustrated which, in particular in the context of using the edge rail as the upper edge rail, permits installing the all-glass door in combination with fixed bearing pins. The hinge fitting 27*a* comprises a bracket portion 85 onto which a bearing insert 89 adapted to be plugged onto the bearing pin fixed to the door jamb is screwed by means of screws 87 inserted transversely to the face of the pane. The bearing member 85 is fixed by means of the screws 33, 35 to the clamping rail section 7 in the same manner as explained for the bearing bush 27**.

The above described edge rail is assembled from a mere three extruded profiles and can be assembled as a modular system without milling or similar operations to form an upper or a lower edge rail of an all-glass door with or without a lock and fitted to the glass pane with a minimum of assembly effort. If the edge rail is not to be fitted with a lock the clamping rail section 5 is dispensed with. The clamping rail section 7 in that case extends preferably over the entire width of the door, although shorter embodiments, in particular in the manner of a corner fitting are possible without modifying the extruded profile.

The claims which follow are to be considered an integral part of the present disclosure. Reference numbers (directed to the drawings) shown in the claims serve to facilitate the understanding of the claims, but are not intended to restrict in any way the language of the claims to what is shown in the drawings, unless the contrary is clearly apparent from the context.

I claim:

1. Edge rail for a longitudinally extending edge (1) of a pane in the form of a window pane (3) or all-glass door with the pane having a pair of oppositely directed faces, comprising at least two clamping rail sections (5, 7) extending in the longitudinal direction of and embracing the edge (1) of the pane and with said rail sections spaced apart in the longitudinal direction of the edge (1), each said rail section being continuous for the length thereof in the longitudinal direction of the edge (1), each clamping rail section comprising two profiled rail members (37, 39) coextensive for the length of said rail section in the longitudinal direction of the edge (1) of the pane and each located on a different opposite face of the pane, means (41) extending transversely to the faces of the pane for interconnecting said rail members so that said rail members form a unit prior to placement along the edge (1) of the pane, at least one fitting member (9, 27) releasably fitted to at least one of the profiled rail members (37), and two cover strips (59) extending in the longitudinal direction of the edge of the pane and each covering a different one of the opposite surface of the clamping rail sections (5, 7) facing outwardly from the faces of the pane, said clamping rail sections (5, 7) being spaced apart in the longitudinal direction thereof and forming a gap extending in the longitudinal direction therebetween on both faces of the pane (3), said at least one fitting member releasably fitted to the clamping rail sections (5, 7) within and filling the gap therebetween and extending in the longitudinal direction of the edge of the pane (1) between the two clamping rail sections (5, 7) and is affixed to at least one of said profiled rail members (37) of each of said clamping rail sections (5, 7) so that said rail sections and fitting member form a continuous unit in the longitudinal direction of the edge of the pane for substantially the length thereof.

2. Edge rail according to claim 1, wherein the fitting member is a lock (9).

3. Edge rail according to claim 2, wherein the lock takes the form of a flanged mortice lock (9) having a flange rail (11) extending in the longitudinal direction of the edge (1) of the pane, and bridging the gap between the clamping rail sections (5, 7) onto which it is screwed.

4. Edge rail according to claim 3, wherein the flange rail (11) is screwed by way of spacer members (17, 19) to a profile side face (21) of one of the profiled rail members (37) of each of the two clamping rail sections (5, 7), said flange rail (11) extending longitudinally in relation to the edge (1) of the pane and at right angles to the face of the pane and being supported against the profile side face.

5. Edge rail according to claim 1, wherein the cover strips (59) each have a pair of longitudinal edges extending in the longitudinal direction of the edge of the pane, the cover strips (59) and the profiled rail members (37, 39) on sides facing each other comprise locking profiles (63, 65, 67, 71) extending in the longitudinal direction of and spaced from the longitudinal edges thereof and locking members (73) extending in the longitudinal direction of the edge of the pane in operative engagement with said locking profiles and affording positive interengaging support between the cover strips (59) and the profiled rail members (37, 39), wherein the locking profiles of the cover strips (59) take the form of ribs (63, 65) projecting towards the profiled rail member (37, 39) and extending in the direction of and at a distance from each of the two longitudinal edges of the cover strip (59).

6. Edge rail according to claim 1 in combination with a window or all-glass door to which it is fitted.

7. Edge rail for a longitudinally extending edge (1) of a pane in the form of a window pane or all-glass door with the pane having a pair of oppositely directed faces, comprising at least one clamping rail section (5, 7) embracing the edge (1) of the pane and extending in the longitudinal direction of the edge (1), said at least one rail section comprising two coextensive profiled rail members (37, 39) each having a pair of spaced longitudinal edges extending in the longitudinal direction of the edge of the pane said coextensive rail members interconnected by clamping means (41) extending transversely to the faces of the pane, said at least one section comprising two cover strips (59) each having a pair of spaced longitudinal edges extending in the longitudinal direction of the edge of the pane and covering said rail members, wherein the cover strips (59) and the profiled rail members (37, 39) on the sides facing each other comprise locking profiles (63, 65, 67, 71) extending in the longitudinal direction of and spaced from the edges of the pane of said cover strips and locking members (73) extending in the longitudinal direction of the edge of the pane and affording positive interengaging support with said locking profile holding the cover strips (59) to the profiled rail members (37, 39), wherein the locking profiles of the cover strips (59) take the form of ribs (63, 65) projecting toward the profiled rail member (37, 39) and extending at a distance from each of the two longitudinal edges of the cover strip (59).

8. Edge rail according to claim 7, wherein the longitudinal edges of the profiled rail members (37, 39) adjoining the window pane (3) are chamfered towards the pane on that side which is remote from the pane.

9. Edge rail according to claim 7, wherein the cover strip (59*b*) takes the form of an extruded profile strip and carries a covering (79) adapted to the configuration of the surface facing outwardly away from the associated said rail member.

10. Edge rail according to claim 7 in combination with a window or all-glass door to which it is fitted.

* * * * *